US007186908B2

(12) United States Patent
Hodesh et al.

(10) Patent No.: US 7,186,908 B2
(45) Date of Patent: Mar. 6, 2007

(54) STRINGED MUSICAL INSTRUMENT PICK WITH INERT ADHESION

(76) Inventors: Mitchell J. Hodesh, 1746 Cherokee Ave., Suite 4-O, Hollywood, CA (US) 90028; Timothy W. Aaron, 1433 Silverlake Blvd., L.A., CA (US) 90026

( * ) Notice: Subject to any disclaimer, the term of this patent is extended or adjusted under 35 U.S.C. 154(b) by 0 days.

(21) Appl. No.: 10/835,166

(22) Filed: Apr. 30, 2004

(65) Prior Publication Data

US 2005/0217456 A1 Oct. 6, 2005

Related U.S. Application Data

(60) Provisional application No. 60/497,902, filed on Aug. 27, 2003.

(51) Int. Cl.
*G10D 3/16* (2006.01)

(52) U.S. Cl. ..... 84/320

(58) Field of Classification Search ..... 84/320–322
See application file for complete search history.

(56) References Cited

U.S. PATENT DOCUMENTS

| | | | | |
|---|---|---|---|---|
| 655,959 | A | 8/1900 | Cochrane | |
| 753,534 | A | 3/1904 | Barnes | |
| 1,009,403 | A * | 11/1911 | Gaynor | 84/322 |
| 1,117,056 | A | 11/1914 | Knackstedt | |
| 1,184,561 | A | 5/1916 | Napoletand | |
| 1,254,577 | A | 1/1918 | Carpenter et al. | |
| 1,263,740 | A | 4/1918 | Burdwise | |
| 1,461,070 | A | 7/1923 | Rudesyle | |
| 1,573,912 | A | 2/1926 | Burdwise | |
| 1,787,136 | A | 12/1930 | Beauchamp | |
| 2,045,571 | A | 6/1936 | Dopyera | |
| 3,181,410 | A | 5/1965 | Phillips | |
| 3,595,118 | A | 7/1971 | Paxton | |
| 4,067,255 | A | 1/1978 | Camaioni | |
| 4,137,814 | A | 2/1979 | Rowley | |
| 4,497,237 | A | 2/1985 | Beall | |
| D291,809 | S | 9/1987 | Jasper | |
| 4,890,531 | A | 1/1990 | Tischer | |
| 4,993,302 | A | 2/1991 | Jonathan | |
| 5,307,723 | A | 5/1994 | De La Rosa | |
| 5,649,634 | A * | 7/1997 | Irizarry | 211/120 |
| 5,973,243 | A | 10/1999 | Christenson | |
| 6,040,512 | A * | 3/2000 | Polley | 84/322 |
| 6,054,643 | A | 4/2000 | Chance et al. | |
| D434,801 | S | 12/2000 | Van Den Berg | |
| 6,791,017 | B2 | 9/2004 | Oskorep | |
| 6,846,977 | B2 | 1/2005 | Oskorep | |
| 6,933,430 | B2 * | 8/2005 | Oskorep | 84/322 |
| 2002/0108483 | A1 * | 8/2002 | Smith | 84/322 |

* cited by examiner

*Primary Examiner*—Kimberly Lockett
(74) *Attorney, Agent, or Firm*—Bruce A. Jagger

(57) ABSTRACT

A conventional guitar pick is retrofitted with a special adhesion material covering a selected surface region of the pick so as to enhance gripping between thumb and finger for playing and to provide convenient temporary storage, when not in use for playing, by temporary attachment onto a nearby object such as the body of the guitar. The adhesion material, specially structured to utilize suction to grip onto any smooth surface without leaving marks or residue when removed, is adhesively attached to the pick in the form of a tape or film to provide a suction gripping surface formed by special structure ranging, from multiple articulated suction cups integrally molded from rubber-like material in a uniform grid pattern, to foam-like material with a random pattern of suction pores of size ranging down to microscopic.

6 Claims, 1 Drawing Sheet

STRINGED MUSICAL INSTRUMENT PICK WITH INERT ADHESION

PRIORITY

Benefit is claimed under 35 U.S.C. § 119(e) of pending provisional application 60/497,902 by M. J. Hodesh and T. W. Aaron filed Aug. 27, 2003.

FIELD OF THE INVENTION

The present invention relates to the field of musical instruments and more particularly to a pick for stringed musical instruments such as guitars, which pick is configured with a region treated with inert adhesion material for improved gripping properties and convenience of standby storage on any nearby smooth surface such as a guitar body.

BACKGROUND OF THE INVENTION

Picks such as those used for playing stringed instruments such as guitars, banjos and the like have been well known and widely used for many years. The pick is held between the player's thumb and one or more fingers, typically the forefinger, and applied to the strings of the musical instrument in a plucking or strumming manner to play music.

Conventional picks for stringed musical instruments are made from resilient plastic material with a smooth surface. Unless gripped tightly, there is tendency, while in use, for the pick to shift away from the initial preferred position, causing distraction and interference with top performance. This means that the player must maintain a tight grip; which causes fatigue over a period of time.

Furthermore, because of the small size of the pick, standby storage between performances is problematic: it can become misplaced, e.g. fall to the floor or into some inaccessible location, and thus may become temporarily or permanently lost, causing at least inconvenience and possible disruption of performance.

Furthermore, the player is repeatedly faced with the problem of where to put the pick temporarily, e.g. between performances or even during performances if both hands are needed momentarily for some other activity such as sorting music, playing another instrument, changing to another style, handling beverages, etc. There are many different approaches to this issue. Some players keep a pocket full of picks to have spares in case of loss, and simply use the pocket for temporary storage as well. Many players find a suitable slot or tapered opening somewhere on the guitar body or head, or on a nearby object such as a music stand or a microphone stand where the pick can be parked or wedged and retrieved when needed.

DISCUSSION OF KNOWN ART

Many structural modifications have been proposed to provide a player with an easily retrievable yet comfortably and securely held pick.

U.S. Pat. No. 5,973,243 to Christenson for a GUITAR PICK discloses a pick with an extension ring portion that fits over the player's forefinger.

U.S. Des. Pat. No. 291,809 shows a GUITAR PICK fitted with an attachment band, presumably to encircle a finger or thumb.

U.S. Pat. No. 4,137,814 to Rowley for a NONSLIP GUITAR PICK discloses a pick attached by a flexible connection such as a chain to a palm piece, relying on "transmission of a tensile force between said pick element and said palm piece".

U.S. Pat. No. 4,497,237 to Beall for a GUITAR PICK discloses a pick including a relatively stiff band movably attached to its top edge.

U.S. Pat. No. 6,054,643 to Chance et al for a GUITAR PICK WITH GRIPPING MEANS discloses a pick or pick holder with a curved finger grip portion on one side adapted to form a cradle for engaging either the thumb or index finger.

U.S. Pat. No. 6,040,512 to Polley discloses a guitar pick fitted with hook and loop closure material, with a patch of mating material fastened to the guitar body.

Addressing the other issue of keeping track of the pick, U.S. Pat. No. 4,067,255 for RETRACTABLE GUITAR PICK discloses attachment of the pick via a flexible cable that retracts onto a reel with a take-up spring located in a housing on the guitar.

OBJECTS OF THE INVENTION

It is a primary object of the present invention to provide an improvement in a pick for a stringed musical instrument that will reduce the likelihood of slipping and shifting between the thumb and finger(s) and thus reduce playing fatigue by not requiring an excessively tight grip.

It is a further object to provide a pick with an "adhesion" region by which it can be temporarily attached to any nearby smooth surface such as the body of a guitar for convenient standby storage and retrieval.

It is a further object to accomplish the foregoing objects with no significant modification to the shape and form of the standard pick; and preferably by a simple addition to an existing pick.

It is a further object that the "adhesion" region should be chemically inert, should not feel particularly "sticky" or tend to adhere to the player's skin, should not be adversely affected by moisture such as sweat, and that it should not leave any residue on the player's skin or on the surface to which it was temporarily adhered, e.g. a lacquered finish on a guitar.

SUMMARY OF THE INVENTION

The foregoing objects have been realized in the present invention wherein a substantial portion of the surface of a conventional guitar pick is covered with a special inert adhesion material that enhances gripping between thumb and finger for playing and that, for storage, grips well onto a smooth surface and yet leaves no residue on the surface when removed, so that it can be temporarily fastened onto a nearby object such as the body of the guitar, when not in use for playing. A special suction adhesion material can be utilized in the form of a tape or film that attaches to the pick by an adhesive. Such adhesion tape may be configured with numerous small suction cups, typically circular, or may be made with a foam-like surface configured with microscopic cavities that act as suction cups and that may be of random size and spacing.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
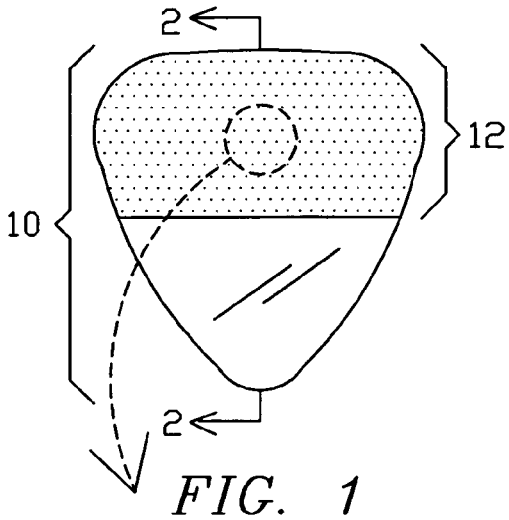
FIG. 1 shows a guitar pick having a selected gripping region treated with special adhesion material in accordance with the present invention.

As shown in FIG. 1, a pick 10 is modified in accordance with the present invention by treating a selected region 12, typically extending from the side opposite the playing tip, ⅓ to ⅔ of the distance toward the tip, on one or both sides of the pick with the special adhesion material. The preferred adhesion material in region 12 utilizes a suction cup principle for adhesion, allowing the pick 10 to be readily stored momentarily or indefinitely by simply attaching it onto a nearby object such as a guitar body: proper material selection for the adhesion material will protect host surfaces such as guitar or furniture finishes from any marks or residue.

Figure 2:
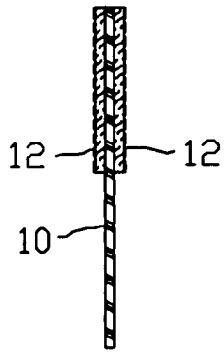
FIG. 2 shows a cross-section taken at 2—2 of FIG. 1.

FIG. 2, a cross-section taken at 2—2 of FIG. 1, shows pick 10 sandwiched between layers 12 of adhesion material, one on each side of pick 10.

Figure 3:
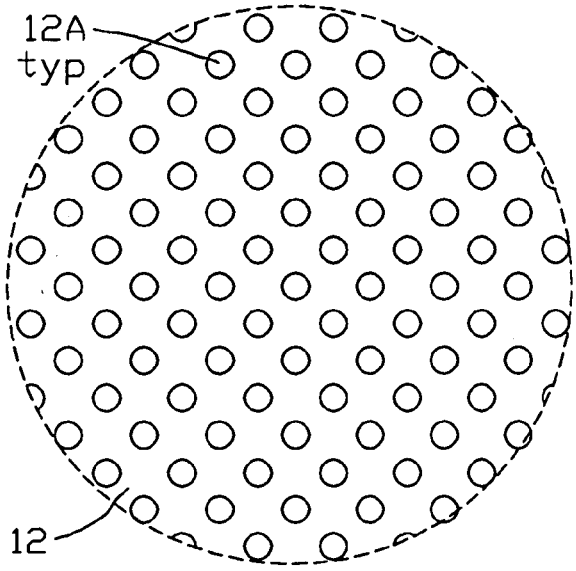
FIG. 3 is an enlargement of the circled portion of FIG. 1, showing an array of suction cups.

FIG. 3 is an enlargement of the circled portion of layer 12 in FIG. 1 showing a square grid pattern array of circular suction cups 12A. In a typical example, the suction cups 12A may be 0.05" in diameter and spaced apart on a square grid as shown, 0.1" per side.

The invention can be practiced with suction cups 12A of different diameter and in different grid patterns, in different density. The cups could be of various sizes, of different shape other than circular and/or they could be arranged randomly, rather than in a pattern. The effectiveness is proportional to the ratio of suction cup area to total area of the gripping patch: in the example as shown with circular suction cups, disengaged, the area ratio is about 44%. With a given square grid spacing, the diameter of the suction cups could be increased up to a working limit where the cups, when engaged with an external surface (which increases the diameter slightly), are just starting to touch each other; in that condition the area ratio would be 78.5%.

Figure 4:
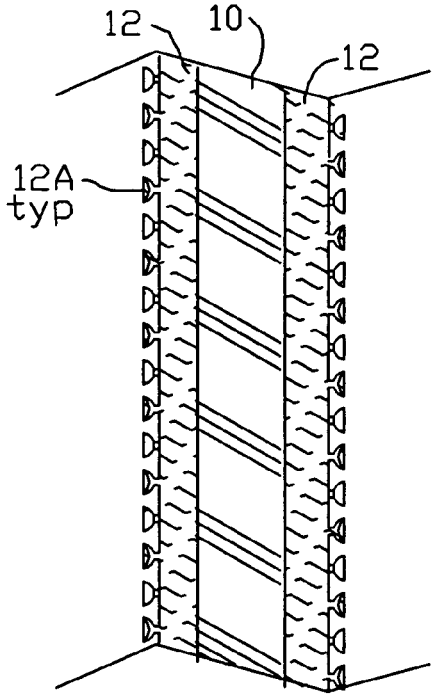
FIG. 4 is an enlargement of a portion of FIG. 2 illustrating adhesion implementation with articulated suction cups.

FIG. 4 is an enlargement of a portion of the cross-section in FIG. 2 showing adhesion layers 12, on both sides of pick 10, of resilient or rubbery material, such as vinyl or a silicon polymer, with the outer surface configured to form articulated suction cups molded integrally as part of layer 12. At the interface of layer 12 and pick 10 these are attached together adhesively, with adhesive applied in assembly or else supplied as a self-adhesive already applied to the attachment side of layer 12 and typically protected by a peel-off protective film as supplied.

Figure 5:
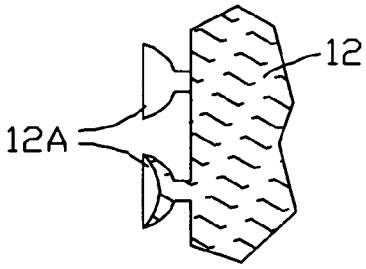
FIG. 5 is a further enlargement of a portion of FIG. 4 showing two articulated suction cups, one in cross-section and one in profile.

FIG. 5 is a further enlargement of a portion of the cross-section of FIG. 4 showing two of the articulated suction cups 12A, one in cross-section and one in profile.

The shape of cups 12A is similar to that of well-known suction cups in general use for many purposes, typically made in much larger sizes than in the present invention.

Figure 6:
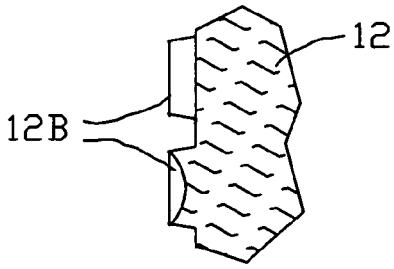
FIG. 6 shows a different suction cup configuration as an alternative to that shown in FIG. 5.

FIG. 6 shows suction cups 12B in a different configuration, which, as an alternative to the shape of cup 12A (FIG. 5), is inherently easier to produce in a molding process.

The invention may be practiced with many different suction cup configurations, including a range of shapes falling between the shapes shown in FIGS. 5 and 6; e.g. the general shape of FIG. 5 with a different diameter and/or different length stem portion behind the cup itself.

Size, shape, density and material may be selected from a wide range of available possibilities as a matter of design choice considering the tradeoffs of cost, feel, produceability and performance (gripping, release, moisture effects, etc.) under different field conditions. Generally the performance of suction cups benefit from the presence of moisture, in contrast to most adhesive tapes. However, with extremely small suction cups and micro-suction foam materials, there can be a limit, as the cells could fill and over-saturate with liquid, causing some degradation in suction.

The gripping surface may be formed in different configurations other than the circular suction cups shown. Closed cell flexible foam-like material may selected for the special property of providing a random pattern of pores or partially open cells of different sizes at a sheared-off surface that can serve as a suction gripping surface. To the extent that the target surface is smooth enough, the cell size can be reduced to microscopic. A residue-free non-adhesive suction base, trademarked "Micro-Suction", with no visually discernable surface pattern, is found on the bottom side of a tape dispenser shown in U.S. Des. Pat. No. D434,801 to Van Den Berg, assigned to Ray Technology Group, Netherlands, marketed by Manco, Inc., a Henkel Group company. Other similar adhesion products may be located with which the present invention can be practiced: a tape with a a flexing foam-like pressure-sensitive suction gripping material on one side that is non-liquid and that contains no bonding agents.

As alternative to providing two gripping layers 12, one on each side of the pick 10, as shown in FIG. 2, the invention can be practiced with only one layer 12 on one side of pick 10, leaving the other side unmodified.

Also the invention can be practiced with layer 12 configured in shapes other than shown, e.g. a circular, square, or rectangular patch, and with the layer 12 extending more or less than the suggested range (⅓ to ⅔ of the pick dimension).

The invention can practiced in conjunction with practically any known stringed musical instrument pick of any size, shape and material.

The invention is not restricted to suction type adhesion layers: other forms of pressure-sensitive adhesives could be utilized provided they meet the basic requirements as described above in the objects of the Invention.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A stringed musical instrument pick, having a playing tip and two substantially parallel opposite flat sides, comprising:

at least one patch of resilient gripping material, including numerous suction cups, said patch of resilient suction gripping material being applied to a flat region of the pick, said patch of resilient suction gripping material being adapted to facilitate gripping of said pick by a musician while said musician is using said pick to play said stringed musical instrument, and to removably grip by suction directly onto a smooth flat surface when not being used to play said stringed musical instrument, whereby the pick can be temporarily stored when not in use and easily retrieved for further use without leaving a residue on said smooth flat surface.

2. The stringed musical instrument pick having a playing tip and two substantially parallel opposite flat sides, comprising:

at least one patch of resilient gripping material, applied to a flat region of the pick, said patch of resilient gripping material being adapted to facilitate comfortable gripping of the pick by a musician while playing a stringed musical instrument, wherein the patch of resilient gripping material is integrally formed from resilient rubber-like material having an outwardly-facing surface configured with numerous outwardly-facing suction members, adapted to removably grip by suction directly on to a smooth host surface sufficiently to temporarily store the pick and to readily release the pick for further use when required without leaving a residue on said smooth host surface.

3. The stringed musical instrument pick as defined in claim 1 comprising one and only one said patch of resilient suction gripping matertal, disposed on only one side of the pick.

4. The stringed musical instrument pick as defined in claim 1, comprising two said patches, disposed in mirror image relationship, one on each of two opposite sides of the pick.

5. The stringed musical instrument pick as defined in claim 1 wherein the resilient suction gripping material comprise a microscopic porous surface that provides a suction cup gripping action.

6. The stringed musical instrument pick as defined in claim 1 wherein the patch of resilient suction gripping material comprises a tape or film adhered to the pick.

* * * * *